United States Patent [19]

Hooper et al.

[11] 4,321,780

[45] Mar. 30, 1982

[54] SNAP CAP FOR ARCHITECTURAL WALL PANEL

[75] Inventors: Christopher C. Hooper, Decatur; Burlan E. Ellison, Duluth; Harry P. Spranca, Dunwoody, all of Ga.

[73] Assignee: Atlantic Building Systems, Inc., Atlanta, Ga.

[21] Appl. No.: 57,006

[22] Filed: Jul. 12, 1979

[51] Int. Cl.[3] ..... E04C 1/34

[52] U.S. Cl. ..... 52/506; 52/466; 52/461; 52/718

[58] Field of Search ..... 52/544, 545, 463–467, 52/460, 461, 470, 469, 462, 716–718, 506

[56] References Cited

U.S. PATENT DOCUMENTS

| | | | |
|---|---|---|---|
| 216,561 | 2/1970 | Colson | D25/1 |
| 1,724,601 | 8/1929 | Kellogg | 52/718 |
| 2,132,400 | 10/1938 | Carren | 52/716 |
| 2,150,130 | 3/1939 | Ragsdale | 52/466 |
| 2,234,799 | 3/1941 | Eason . | |
| 2,356,833 | 8/1944 | Doe . | |
| 2,428,361 | 10/1947 | Doe . | |
| 2,500,377 | 3/1950 | Poapitch | 52/718 |
| 2,855,871 | 10/1958 | Huntington . | |
| 3,139,961 | 7/1964 | Ferrell . | |
| 3,341,999 | 9/1967 | Berg | 52/395 |
| 3,509,675 | 5/1970 | McClain | 52/470 |
| 3,606,720 | 9/1971 | Cookson | 52/545 |
| 3,696,575 | 10/1972 | Armstrong | 52/466 |
| 3,757,480 | 9/1973 | Young | 52/464 |
| 3,825,229 | 7/1974 | Bartlett | 52/716 |
| 3,849,956 | 11/1974 | Collins | 52/376 |
| 4,089,145 | 5/1978 | DeVries | 52/461 |
| 4,117,638 | 10/1978 | Kidd | 52/200 |
| 4,184,299 | 1/1980 | East | 52/463 |

FOREIGN PATENT DOCUMENTS

| | | | |
|---|---|---|---|
| 600197 | 1/1926 | France | 52/469 |
| 963461 | 7/1950 | France | 52/465 |
| 1076735 | 10/1954 | France | 52/544 |
| 2372281 | 7/1978 | France | 52/466 |
| 1514936 | 6/1978 | United Kingdom | 52/730 |

*Primary Examiner*—Price C. Faw, Jr.
*Assistant Examiner*—Henry E. Raduazo
*Attorney, Agent, or Firm*—Cushman, Darby & Cushman

[57] ABSTRACT

An elongated cap is provided which is utilizable in wall panel and standing seam systems for performing various fastening and protecting functions. The cap cooperates with a pair of clip arms extending upwardly from a body portion, and operatively attached to a panel or at a junction between panels, of a system with which the cap is associated. The cap includes a first end which is looped around a first flange extending perpendicularly to one of the clip arms, and the second end of the cap is pivoted about the interconnection between the first end and the first flange. A second flange is provided extending parallel to the first flange and outwardly therefrom, and is connected to the other of the clip arms. A second end of the cap, opposite the first end, is formed to provide an inwardly directed cam, and resiliency is provided in the assembly. As the second end of the cap is pivoted about the first end the cam engages the second flange, the resiliency of the system allows the cam to move past the second flange, and then the inherent resiliency returns the second flange and cam to a non-displaced position, with the cap then locking the flanges together.

12 Claims, 8 Drawing Figures

SNAP CAP FOR ARCHITECTURAL WALL PANEL

BACKGROUND AND SUMMARY OF THE INVENTION

The invention relates to a capping assembly, and method of utilization thereof, for metal panel systems. In particular, the invention is useful with architectural sheet metal wall panels such as shown in U.S. Pat. No. Des. 216,561, and in standing seam roof assemblies such as shown in U.S. Pat. Nos. 4,089,145 and 4,117,638.

In conventional architectural wall panel systems, distinctive hill and valley surface manifestations are provided, and at the valley floors intermediate each panel, as well as valley floors between panels, it is necessary or desirable to secure the building panels to underlying supporting mechanisms (purlins). Such fasteners however are then visible from the exterior of the panel and destroy a portion of the aesthetic effect desired by utilizing such panels. Additionally, since the fasteners are exposed they can be readily removed by unauthorized persons, with resultant potential for vandalism or security breaches of the building with which the panels are utilized. Conventional camming arrangements for the fasteners can be difficult to utilize in view of the steep slanting side walls forming the valleys, which do not provide room to maneuver, and which make difficult the utilization of caps that do not adversely affect the desired aesthetic effect obtained by utilizing the panels.

In conventional standing seam roof systems, caps are often provided which secure the adjacent longitudinal raised edges of adjacent panels together along the length thereof, and assist in sealing thereof, such attachment and sealing being affected simultaneously with the securement of the panels to the purlins or the like. Conventionally, upstanding arms will be provided associated with the adjacent edges of panels, with each arm having an outwardly extending flange generally perpendicular to the arms, and parallel to the general plane of the roof. Conventional caps are secured around such flanges to secure them in place either by effecting a relative sliding movement therebetween, by specially shaping the structures so that the cap can be snapped thereover (see U.S. Pat. Nos. 2,356,833 and 2,428,361), or most commonly by bending the sides of the cap into engagement with under surfaces of the flanges utilizing a conventional seamming machine or appropriate hand tools, as in U.S. Pat. No. 4,089,145. Each of such prior art systems either has restricted versatility, requires accessory components, or requires special machinery or tools to effect attachment.

According to the present invention, a capping assembly, and method of utilization thereof, has been provided which is suitable for use both with architectural wall panels and in conventional standing seam roof systems, eliminating the drawbacks associated with prior art structures and methods in each of these systems. The basic component of the assembly comprises an elongated cap including a substantially planar body portion; a first longitudinal end of the body portion; and a second longitudinal end thereof. The first longitudinal end is formed as a turned-back looped portion terminating in a free end, the turned-back portion from the loop to the free end being substantially parallel to the body portion. The second end is formed as a turned back looped portion, the turned-back portion terminating in a rounded portion (which provides a camming function) and in an angled (downwardly extending) portion extending away from the rounded portion in a direction away from the body portion, the turned-back portion being substantially parallel to the body portion, and the angled portion making a positive angle between 0° and 90° with respect to the body portion.

In utilizing the capping assembly according to the invention with architectural wall panels, the cap provides means for covering fasteners in the panel valleys so that the fasteners cannot be seen and ready access thereto is prevented while still providing an aesthetic effect of the panels not significantly different than the aesthetic effect of the panels per se. A plurality of spring clips are fastened to the valley bottom at spaced points therealong, each spring clip having a pair of arms with a flange extending outwardly from each arm and generally parallel to the valley bottom. The first arm is substantially perpendicular to the valley bottom, while the second arm extends at a slant inwardly toward the first arm and makes a positive angle of less than 90° with respect to the valley bottom. The first end of the cap is looped around the first flange of each of the spring clips, and then the second end of the cap is pivoted about the first end downwardly toward the second flange, the rounded (cam) portion of the second end abutting the second flange, and these components moving outwardly with respect to each other due to the inherent resiliency of the second clip arm and/or the cap second end turned-back portion. The pivotal movement continues until the cam passes the second flange, at which point the inherent resiliency of the components moves them toward one another and locks the cap in place with the arms. The angled portion is substantially parallel to the second clip arm in the locked position, and thus abuts it. Utilizing such a system, the cap may readily be secured in place even in the confined area between the side walls forming the panel valley, which side walls normally extend and flare outwardly at an angle of greater than 60° with respect to the valley floor. By appropriately dimensioning the spring clips and the cap, the cap extends the full width between the valley sides at a point spaced only slightly above the valley floor so that the fasteners are not seen at all, but rather a false valley bottom is provided, one that allows the same visual effect of depth and contour that is present in the panel per se.

In utilizing the cap of the invention in standing seam roof constructions, it is associated with outwardly extending flanges formed on the upright raised edges of adjacent panels. At predetermined positions along such edges fastening components are provided between the raised panel edges which fasten the panels to the purlins, such components conventionally comprising oppositely directed flanges at the tops thereof which overlay the flanges of the panels. The first end of the cap is disposed around the first flange of the panel seam, and the angled, downwardly extending portion of the cap second end is grasped to pivot the cap second end about the first end so that the cam portion thereof engages the second flange. Resilient sealing material is provided between the panel raised edges so that the second flange is moved laterally inwardly to allow passage of the cam therepast, and then is returned to its original position whereby the cap is locked in engagement with the flanges.

It is the primary object of the present invention to provide a versatile, advantageous capping system, and advantageous methods of use thereof, for architectural wall panel systems, standing seam roof systems, and the like. This and other objects of the invention will become clear from an inspection of the detailed description of the invention, and from the appended claims.

DETAILED DESCRIPTION OF THE DRAWINGS

Figure 1:
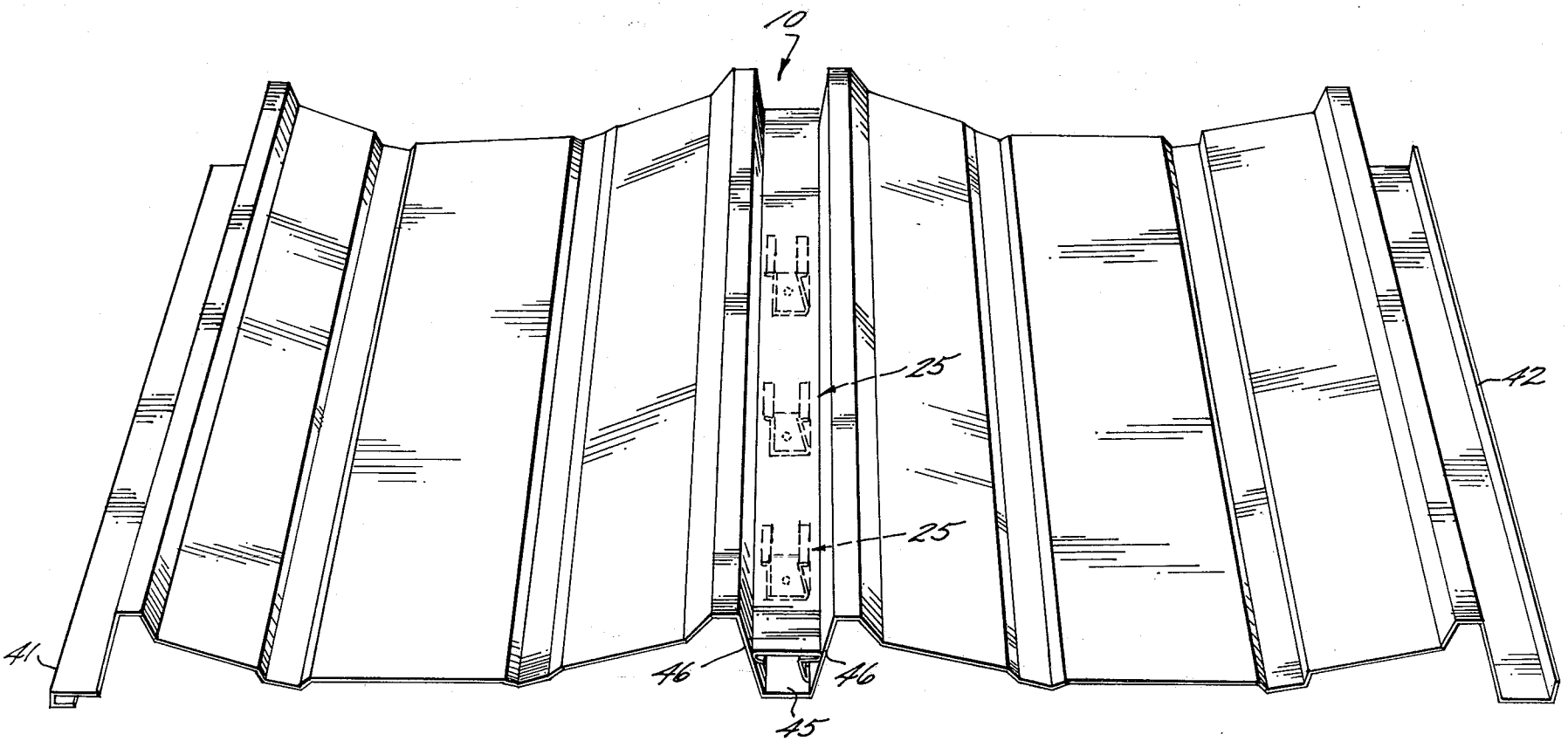
FIG. 1 is a perspective view of an architectural wall panel in combination with an exemplary fastener-covering assembly according to the invention.
Figure 2:
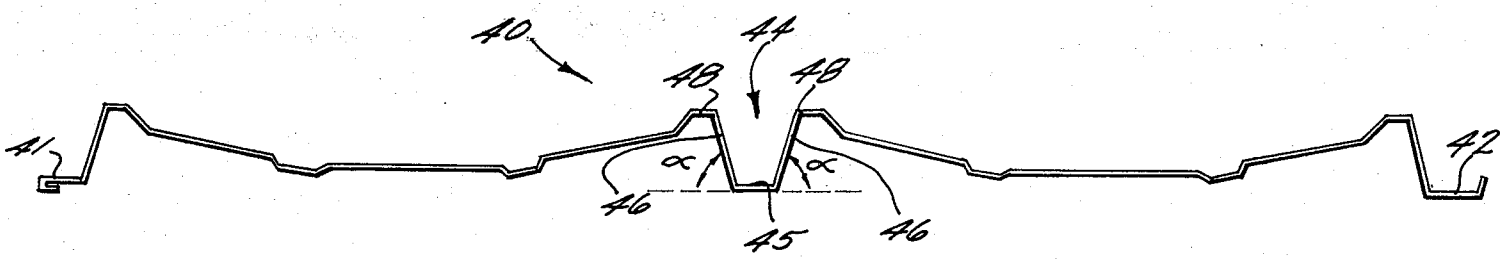
FIG. 2 is a side view of the architectural wall panel per se of FIG. 1.
Figure 4:
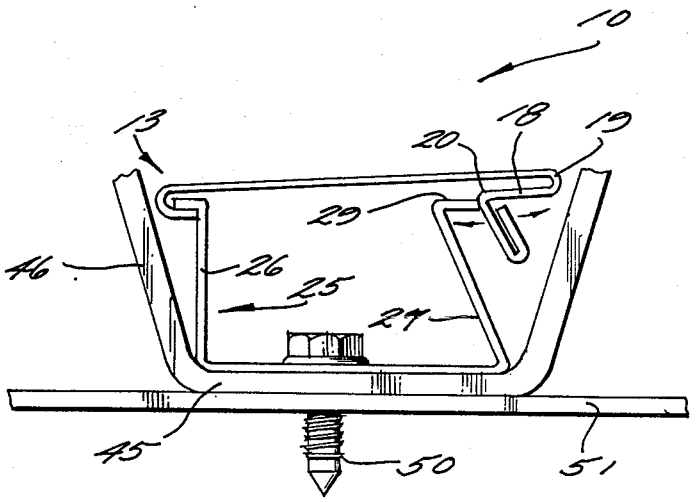
FIGS. 3 through 5 are progressive views showing the utilization of an exemplary cap according to the invention for covering fasteners utilized with an architectural wall panel such as that of FIG. 2.
Figure 5:
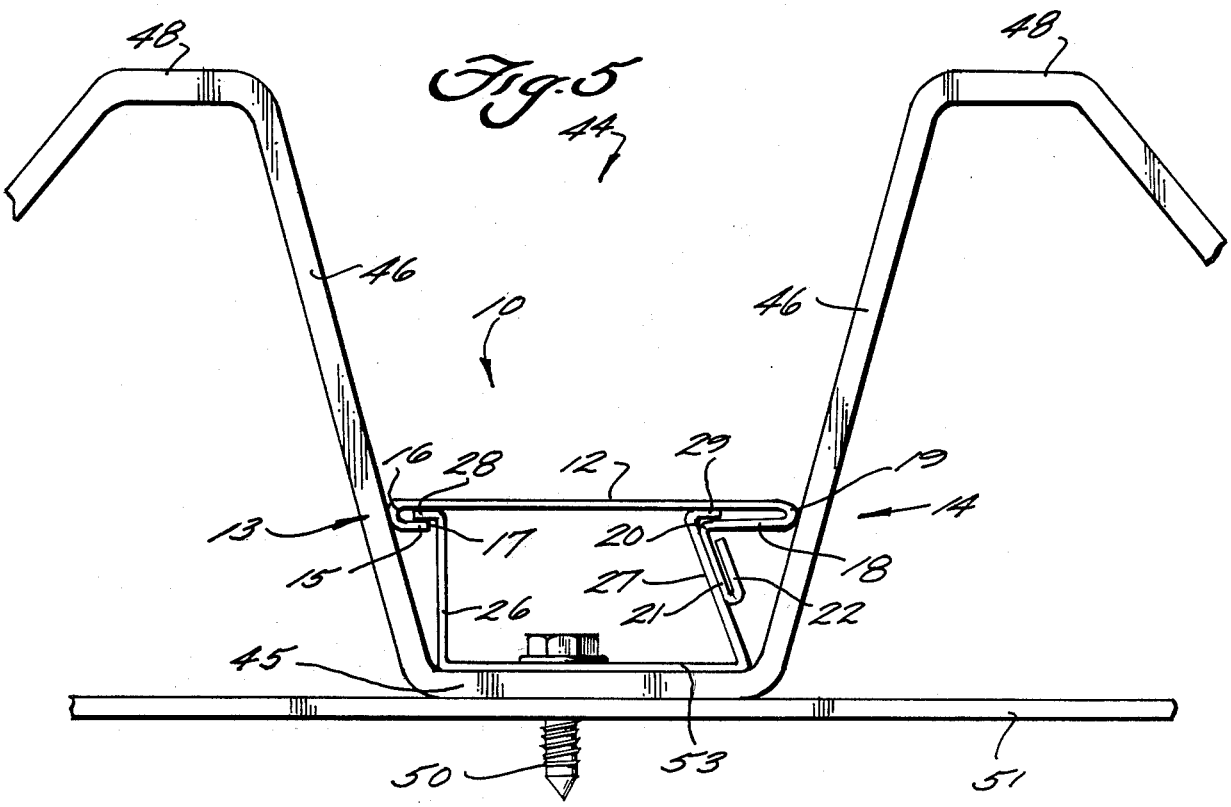
Figure 6:
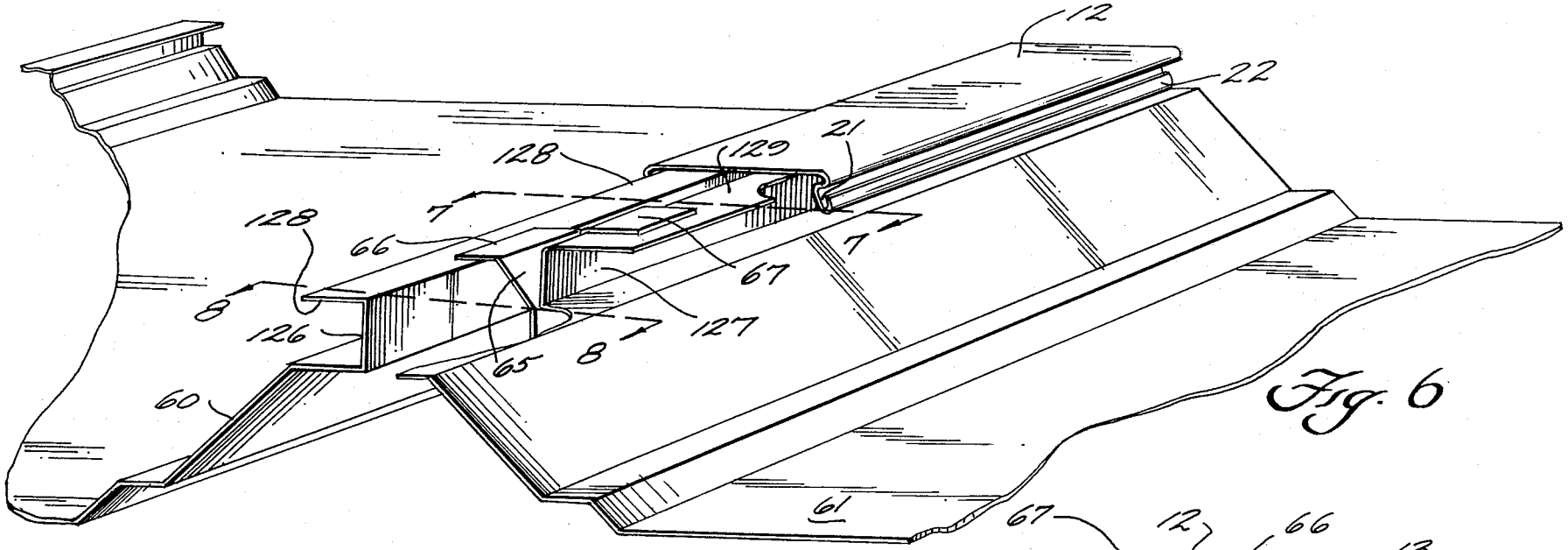
FIG. 6 is a perspective view, with portions cut away for clarity, of an exemplary capping assembly according to the invention in use with a standing seam roof system.
Figure 7:
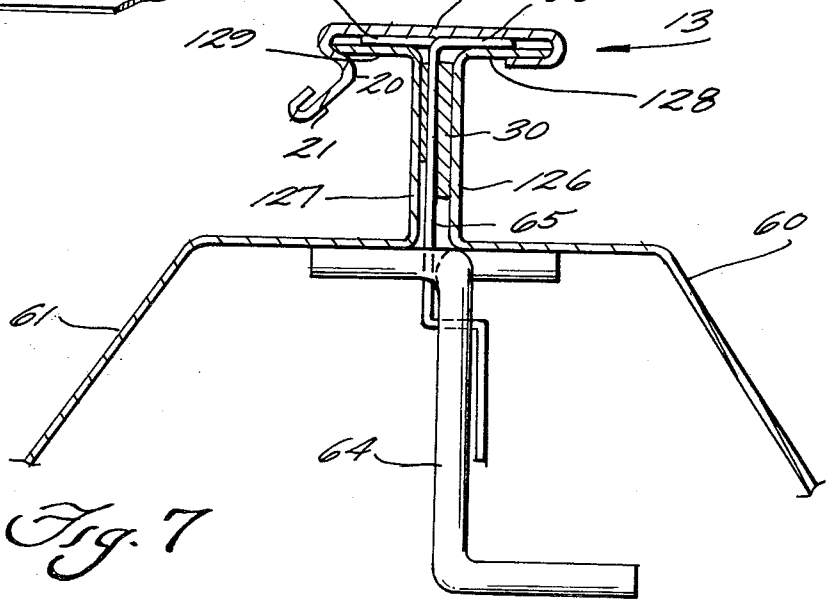
FIGS. 7 and 8 are side views of the assembly of FIG. 6 taken at an attachment point and at a point intermediate two attachment points, respectively; along lines 7—7 and 8—8, respectively, of FIG. 6.
Figure 8:
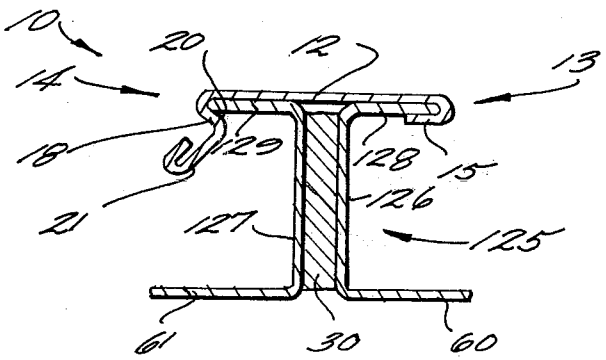

An exemplary cap according to the present invention, for utilization in the systems and in practicing the methods of the invention, is illustrated in FIGS. 1 and 3 through 8 of the drawings, one version of the cap being illustrated in FIGS. 1 and 3 through 5, and a second version being illustrated in FIGS. 6 through 8. The cap, indicated generally at 10 in the drawings, includes a body portion 12, a first end 13, and a second end portion 14. The body portion 12 is substantially planar and the entire cap is elongated (see FIGS. 1 and 6), the first 13 and second 14 ends being disposed along the longitudinal edges thereof.

The first end 13 of the cap 10 includes a turned-back portion 15 which forms a loop 16 and terminates in a free edge 17. The turned-back portion 15 is substantially parallel to the body portion 12. The second end portion 14 includes a turned-back portion 18 and a loop 19, with an inwardly directed rounded portion 20 being formed on the turned back portion 18. Rounded portion 20 functions as a cam in utilizing the cap 10. The turned-back portion 18 is substantially parallel to the body 12. An angled portion 21 is provided which extends downwardly from the rounded portion 20 at a positive angle less than 90° with respect to the body 12, and preferably the angled portion 21 is long enough to allow for grasping thereof with the thumb and forefinger, and is doubled over, as indicated at 22.

The cap 10 is utilized with a spring clip arrangement, and is moveable into locking engagement therewith. In the embodiment of FIGS. 1 through 5, the spring clip is indicated generally at 25 and is an accessory number used to attach the cap 10 to architectural wall panels. In the embodiment of FIGS. 6 through 8, the spring clip comprises the raised longitudinal edges of a pair of adjacent sheet metal roofing panels or the like, and is indicated generally at 125. In each case, the spring clip includes a pair of clip arms 26, 27; 126, 127 and pivot means are provided for allowing pivotal movement of the cap 10 about its first end 13. Such pivotal means includes a first flange 28, 128 extending outwardly from the first arm 26, 126 and adapted to be surrounded on three sides of the end thereof by the first end 13 of the cap 12. Resilient means are provided associated with at least one of a clip arm (i.e., 27, 127), and the cap second end 14 to provide for relative movement between the cam 20 and arm 27, 127. The second arm includes a second flange 29, 129 extending outwardly therefrom, parallel to the first flange 28, 128, and for engaging the cam 20. In the FIGS. 1 through 5 embodiment, the resilient means comprises the inherent resiliency of the arm 27 and/or cap second end 14 (specifically, turned back portion 18 thereof), while in the FIGS. 6 through 8 embodiment the resilient means comprises mastic 30, or some other resilient sealing material, disposed between the arms 126, 127 (see FIGS. 7 and 8 in particular) and/or cap second end 14.

With particular reference to FIGS. 1 through 5, an architectural panel assembly is provided which includes a plurality of sheet metal panels 40 interconnected along parallel longitudinal edges 41, 42 thereof. The panels include a plurality of deep valley portions. Preferably, an intermediate valley portion 44 is associated with each panel 40, and it includes a valley bottom portion 45 and valley defining opposed side portions 46 which extend upwardly from opposite sides of the bottom portion 45 at steep angles (see angles $\alpha$ in FIG. 2). Normally such angles Alpha would be greater than 60°. For the embodiment illustrated in the drawings, the angle $\alpha$ is equal to about 75°. The distance from the hills 48 to the valley bottom portion 45 is chosen so that significant depth for aesthetic effect is provided; preferably, the depth of the valleys 44 (dimension of a line perpendicular to bottom portion 45 to the tops of the hills 48) is 2 to 2½ inches.

Fasteners, such as screws 50, pass through the bottom portion 45 of each valley 44 to attach the panels 42 underlying structural members such as purlins 51. A plurality of the spring clips 25 are also mounted in place, preferably being attached to the bottom portion 45 with the same fasteners 50 that attach the bottom portion 45 to the purlins 51. The width of the body portion 12 of the cap 10 is the same as the distance between the valley sides 46 at the height of the flanges 28, 29 so that the cap body portion 12 completely extends across the valley, and the cap 10 is as long as the panel valley 44. The length of the clip arms 26, 27 is chosen so that the flanges 28, 29 are about ½ inch from the valley bottom portion 45 so that the valley 44 has significant depth even once the cap 10 is disposed in place. The clip arms 26, 27 of the spring clip 25 are connected together by a body portion 53 which is substantially planar and has a width corresponding to the width of the bottom portion 45.

Figure 3:
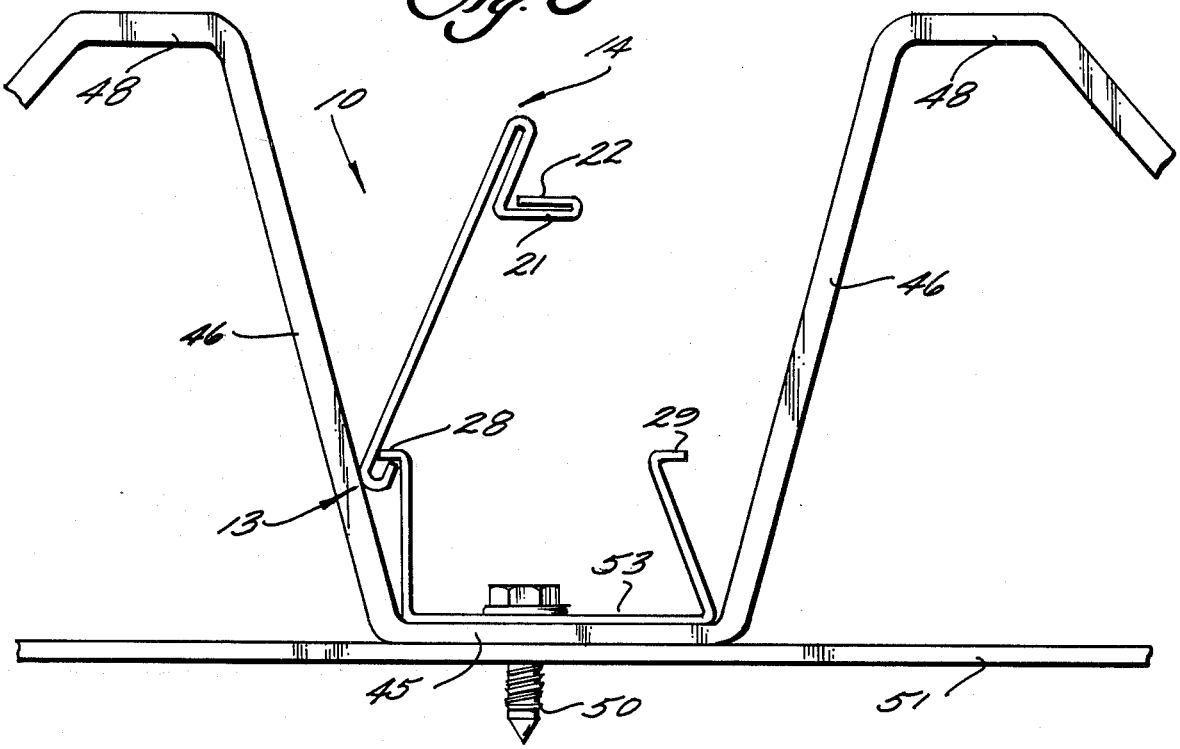

Once the spring clips 25 are fastened in place at predetermined positions along the length of the valley 44 (see FIG. 1), the first end 13 of the cap 10 is looped around the first flanges 28 of each of the spring clips 25 (see FIG. 3). Then the cap 10 is pivoted about its first end 13, without substantial lateral displacement of the first clip arm 26, toward the second flanges 29. As indicated in FIG. 4, the cam portion 20 of cap 10 engages the second flange 29, and continued pivotal movement of the cap 10 about the first end 13 causes the second clip arm 27 to deflect inwardly, and/or the cam portion 20 of the cap 10 to deflect outwardly, as by turned-back portion 18 pivoting slightly about looped portion 19. This motion is continued until the cam 20 passes past the second flange 29, at which time the inherent resiliency of the arm 27 moves it toward looped portion 19 of cap 10, and/or the inherent resiliency of the turned-back portion 18 and loop 19 causes the portion 18 to snap back to its original position, as illustrated in FIG. 5. In this position, the cap 10 is in locking engagement with flanges 28, 29 and their associated arms 26, 27. The angled portion 21 in this position abuts against the arm 27. The cap 10 thus completely covers the width between the valley sides 46, covering the fasteners 50, and providing essentially the same aesthetic impression as is provided by the panel per se.

In the embodiment illustrated in FIGS. 1 through 5, it will be noted that the turned back portion 18 is much longer than the turned back portion 15, and that the angled portion 21 is of substantially the same length as the turned back portion 18. The distance from the free end 17 to the loop 16 is substantially equal to the distance between the clip arm 26 and the panel valley side 46 at the first flange 28.

In the embodiment illustrated in FIGS. 6 through 8, the clip arms 126, 127 are raised longitudinal edge portions of conventional sheet metal roofing panels 60, 61 or the like. At various spaced points along the raised edges 126, 127, structure is provided for attaching the edges to the underlying structural support (purlins). Such structure includes members having a body portion 64 and a tab portion 65, the tab having opposed flanges 66, 67 formed on the top thereof parallel to the arm flanges 128, 129 and overlying the tops thereof. The members 64, 65 can have any desired construction, but preferably are of the type illustrated in copending commonly assigned application Ser. No. 56,943 filed July 12, 1979 entitled "Standing Seam Roof System", by Ellison, Spranca, and Hooper.

To snap the cap 12 in place in locking engagement with the raised edges 126, 127, the first end 13 thereof is looped around the flanges 66, 128, the angled portion 21 is grasped between the thumb and forefinger (or utilizing a tool), and the cap 10 is rotated about the first end 13 moving the cam 20 towards the second flange 129. The latching action provided is the same in this embodiment as in the embodiments of FIGS. 1 through 5 except that the resiliency required to effect latching is provided by the resilient sealing material 30 disposed between the members 126, 127.

It will be noted in this embodiment that the first end turned-back portion 15 is longer than the second end turned-back portion 18, and that the angled portion 21 is substantially longer than either.

The view in FIG. 7 is taken along line 7—7 of FIG. 6, at the attaching structure 64, 65, while the view in FIG. 8 is taken at lines 8—8 in FIG. 6, at a point spaced from base supporting structure 64, 65.

It will thus be seen that according to the present invention a cap arrangement has been provided, as well as paneling systems and methods of use thereof, which has great versatility, can be moved into operative association with supporting components even in very tight spaces, is simple and easy to make and install, requiring no special tools, and effectively performs the desired functions in whatever embodiments utilized. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures, assemblies, and methods.

What is claimed is:

1. A capped assembly for a metal panel system, comprising a spring clip including a pair of clip arms each extending upwardly from a body portion, and having first and second flanges, one extending generally perpendicularly to each of said clip arms, and said flanges extending in opposite directions;

an elongated cap, including first and second ends, cooperating with said clip arms and for locking with said clip arms cap including a substantially planar body portion intermediate said first and second ends thereof;

said clip arm from which said first flange extends being substantially perpendicular to said cap planar body portion, and said clip arm from which said second flange extends making a positive angle with respect to said cap planar body portion, slanting inwardly toward said other clip arm;

pivot means for providing pivotal movement of said cap first end with respect to said first flange so that said cap can pivot about said first flange without displacement of its associated arm, and so that said second end of said cap will pivot into engagement with said second flange, said pivot means including said cap comprising a body portion, and a turned-back, looped portion terminating in a free end, for engaging and surrounding said first flange on three sides;

said second end of said cap formed to provide a cam extending inwardly toward said clip arms; and resilient means provided with at least one of a said clip arm and said cap second end to provide for relative movement of said cam and said second flange when said cam is pivoted into engagement with said second flange so that said cam will pass said second flange and move into locked engagement with said clip arms, said resilient means comprising the inherent resilience of said clip arm from which said second flange extends and the inherent resilience of said cap adjacent said cam portion thereof.

2. An assembly as recited in claim 1 wherein said body portion from which said clip arms extend is substantially planar and substantially parallel to said cap body portion, and having a given width, and wherein the width of said cap is greater than said given width, and greater than the distance between said cap engaging arms.

3. An assembly as recited in claim 1 wherein said cap further includes a portion extending downwardly from said cam portion at a positive angle with respect to said cap body portion, said angle being the compliment of the angle made by said clip arm from which said second flange extends, so that when the cap is in locked engagement with said clip arms said downwardly extending portion is in face-to-face engagement with said clip arm from which said second flange extends.

4. An assembly as recited in claim 3 wherein said positive angle with respect to said cap body portion is less than 90°.

5. An assembly as recited in claim 3 wherein said positive angle with respect to said cap body portion is greater than about 60°.

6. An assembly as recited in claim 3 wherein said positive angle with respect to said cap body portion is between about 60° to about 75°.

7. An assembly as recited in claim 3 wherein said positive angle with respect to said cap body portion is about 75°.

8. An assembly as recited in claim 3 wherein said first and second flanges extend in opposite directions to cooperate with said cap first end and said cap second end so that said cap planar body portion is generally parallel to the plane of said spring clip body portion when said cap is in an assembled arrangement with said spring clip.

9. An architectural panel assembly comprising a plurality of sheet metal panels interconnected along parallel longitudinal edges thereof, said panels including a plurality of deep valley portions formed by a valley bottom portion and valley defining opposed side portions which extend upwardly from opposite sides of said valley bottom portion at steep angles;

a plurality of fasteners extending through said valley bottom portion for attaching said panels to underlying structural members;

a plurality of spaced spring clips, each having a body portion coextensive with said valley bottom, and a pair of clip arms extending upwardly from said body portion;

an elongated cap having substantially the same length as the length of said panel; and means for operatively attaching said cap to said clip arms so that said cap covers the entire width between said valley opposed side portions, at a level spaced from said valley bottom, said attaching means comprising first and second flanges formed on said clip arms, one flange associated with each arm, and each flange extending in a dimension substantially parallel to said valley bottom, and said flanges extending away from each other; first and second ends of said cap, said second end of said cap formed to provide a cam extending inwardly toward said clip arms; said clip arm from which said second flange extends making a positive angle of less than 90° with respect to said valley bottom portion, and slanting toward said other clip arm, and said cap having a width substantially greater than the distance between said first and second flanges; pivot means for providing pivotal movement of said cap first end with respect to said first flange so that said cap can pivot about said first flange without displacement of its associated arm, and so that said second end of said cap will pivot into engagement with said second flange; and resilient means for effecting passage of said cam past said second flange during pivotal movement of said cap into a locked position with respect to said arms, and comprising the inherent resilience of said clip arm from which said second flange extends and the inherent resilience of said cap adjacent said cam portion thereof, so that said fasteners cannot be seen and ready access thereto is prevented while providing an aesthetic effect of the panels not significantly different than the aesthetic effect of the panels per se.

10. An assembly as recited in claim 9 wherein said clip arm from which said first flange extends is perpendicular to said valley bottom portion; and wherein said pivot means includes said first cap end comprising a body portion, and a turned-back, looped portion terminating in a free end, for engaging and surrounding said first flange on three sides; the distance from said free end to said looped portion being substantially equal to the distance between said clip arm supporting said first flange and the nearest panel valley side, at said first flange.

11. An assembly as recited in claims 9 or 10 wherein said cap further includes a portion extending downwardly from said cam portion at a positive angle with respect to said cap body portion, said angle being the compliment of the angle made by said clip arm from which said second flange extends, so that when said cap is in locked engagement with said clip arms said downwardly extending portion is in face-to-face engagement with said clip arm from which said second flange extends.

12. A capped assembly for a metal panel system, comprising a spring clip including a pair of clip arms each extending upwardly from a body portion, and having first and second flanges, one extending generally perpendicularly to each of said clip arms, and said flanges extending in opposite directions; said spring clip being formed by first and second adjacent metal panel members, a portion of at least one of the terminal ends of said first member including a first clip arm upwardly extending from said first member and having said first flange generally perpendicular to said first clip arm, and a portion of at least one of the terminal ends of said second member including a second clip arm upwardly extending from said second member and having said second flange generally perpendicular to said second clip arm, so that said first and second flanges extend in opposite directions when said first and second clip arms are adjacent in an assembled position;

an elongated cap, including first and second ends, cooperating with said clip arms and for locking with said clip arms;

pivot means for providing pivotal movement of said cap first end with respect to said first flange so that said cap can pivot about said first flange without displacement of its associated arm, and so that said second end of said cap will pivot into engagement with said second flange; said pivot means including said cap first end comprising a body portion, and a turned-back, looped portion terminating in a free end, for engaging and surrounding said first flange on three sides;

said second end of said cap formed to provide a cam extending inwardly toward said clip arms; and resilient means provided with at least one of a said clip arm and said cap second end to provide for relative movement of said cam and said second flange when said cam is pivoted into engagement with said second flange so that said cam will pass said second flange and move into locked engagement with said clip arms.

* * * * *